US010172462B2

(12) United States Patent
Skog

(10) Patent No.: US 10,172,462 B2
(45) Date of Patent: Jan. 8, 2019

(54) SEATING FURNITURE

(71) Applicant: Sykkylven Stal A/S, Sykkylven (NO)

(72) Inventor: Lars Magnus Skog, Sykkylven (NO)

(73) Assignee: Sykkylven Stal A/S, Sykkylven (NO)

( * ) Notice: Subject to any disclaimer, the term of this patent is extended or adjusted under 35 U.S.C. 154(b) by 0 days.

(21) Appl. No.: 15/521,196

(22) PCT Filed: Oct. 27, 2015

(86) PCT No.: PCT/NO2015/050199
§ 371 (c)(1),
(2) Date: Apr. 21, 2017

(87) PCT Pub. No.: WO2016/068720
PCT Pub. Date: May 6, 2016

(65) Prior Publication Data

US 2017/0354255 A1 Dec. 14, 2017

(30) Foreign Application Priority Data

Oct. 27, 2014 (NO) ..... 20141278

(51) Int. Cl.
*A47C 3/026* (2006.01)
*A47C 1/032* (2006.01)

(52) U.S. Cl.
CPC ..... *A47C 1/03205* (2013.01); *A47C 1/032* (2013.01); *A47C 1/03255* (2013.01); *A47C 1/03283* (2013.01)

(58) Field of Classification Search
CPC ..... A47C 1/03205; A47C 1/03255; A47C 1/03283
(Continued)

(56) References Cited

U.S. PATENT DOCUMENTS 3,989,297 A * 11/1976 Kerstholt ..... A47C 1/022 297/300.3
4,200,332 A 4/1980 Brauning
(Continued)

FOREIGN PATENT DOCUMENTS

DE 2843058 A1 4/1980
DE 19810768 A1 9/1999
(Continued)

OTHER PUBLICATIONS

International Search Report issued in International Application No. PCT/NO2015/050199 dated Jan. 20, 2016.
(Continued)

*Primary Examiner* — Rodney B White
(74) *Attorney, Agent, or Firm* — Arent Fox LLP

(57) ABSTRACT

A seating furniture includes a seat device and a backrest device connected via at least one first rotatable coupling in respective coupling portions (P) of the backrest device and at rear portion (B) of the seat device. A base supports the seat device and the backrest device. The backrest device comprises a portion extending in a direction towards the base and past the first rotatable coupling, and the portion is rotatably coupled to and supported on the base via at least one respective link arm. The seat device is rotatably coupled to and supported on the base via a second rotatable coupling attached closer to front end (F) of the seat device than the first rotatable coupling. A lockable control device controls the movements between the backrest device and the seat device. The construction is well-balanced, and low forces are required to adjust the chair in all positions.

9 Claims, 4 Drawing Sheets

(58) Field of Classification Search
USPC ..... 297/300.2, 300.3, 317, 322, 341, 342
See application file for complete search history.

(56) References Cited

U.S. PATENT DOCUMENTS 4,270,797 A * 6/1981 Brauning ..... A47C 1/03255 297/300.3
4,364,605 A * 12/1982 Meiller ..... A47C 1/0244 297/300.3
4,432,582 A * 2/1984 Wiesmann ..... A47C 1/03216 297/300.3
4,537,445 A * 8/1985 Neuhoff ..... A47C 1/03255 297/300.3
4,603,905 A * 8/1986 Stucki ..... A47C 1/0244 297/300.3
4,640,547 A * 2/1987 Fromme ..... A47C 1/0325 297/300.3 X
4,640,548 A * 2/1987 Desanta ..... A47C 1/03255 297/300.3 X
4,641,886 A * 2/1987 Dauphin ..... A47C 1/03238 297/300.3
4,682,814 A * 7/1987 Hansen ..... A47C 1/03255 297/300.3
4,684,173 A * 8/1987 Locher ..... A47C 1/03255 297/300.3
4,709,962 A * 12/1987 Steinmann ..... A47C 1/03255 297/300.3
4,747,640 A * 5/1988 Locher ..... A47C 1/03283 297/300.3 X
4,761,033 A * 8/1988 Lanuzzi ..... A47C 1/03255 297/300.3
4,765,679 A * 8/1988 Lanuzzi ..... A47C 1/03255 297/300.3
4,787,673 A * 11/1988 Locher ..... A47C 3/026 297/300.3
4,818,020 A * 4/1989 Meiller ..... A47C 1/022 297/300.3
4,832,407 A * 5/1989 Serber ..... A47C 7/506 297/300.3
4,877,291 A * 10/1989 Taylor ..... A47C 1/03255 297/300.3
4,966,411 A * 10/1990 Katagiri ..... A47C 1/0325 297/300.3
5,308,144 A * 5/1994 Korn ..... A47C 1/03255 297/300.2
5,397,165 A * 3/1995 Grin ..... A47C 1/03255 297/322 X
5,423,594 A * 6/1995 Hancock ..... A47C 1/0325 297/300.2
5,425,566 A * 6/1995 Buchacz ..... A47C 1/03255 297/300.3
5,499,861 A * 3/1996 Locher ..... A47C 1/03255 297/317 X
6,155,645 A * 12/2000 Bedrich ..... A47C 1/0355 297/300.3
6,234,573 B1 5/2001 Roder et al.
6,609,755 B2 * 8/2003 Koepke ..... A47C 1/03255 297/300.3 X
6,874,853 B2 * 4/2005 Wild ..... A47C 1/03255 297/300.3 X
7,097,249 B2 * 8/2006 Igarashi ..... A47C 1/03 297/300.2 X
7,410,215 B2 * 8/2008 Dehli ..... A47C 1/03283 297/300.3 X
8,434,822 B2 * 5/2013 Asbjornsen ..... A47C 1/035 297/300.3
8,783,770 B2 * 7/2014 Tanaka ..... A47C 1/0342 297/300.3 X
8,998,322 B2 * 4/2015 Horiki ..... A47C 1/03255 297/300.3 X
2003/0137173 A1 * 7/2003 Kinoshita ..... A47C 7/405 297/300.3

FOREIGN PATENT DOCUMENTS

DE 202007006664 U1 7/2007
EP 1915925 A1 4/2008
FR 2627968 A1 9/1989
WO WO 92/04844 A1 4/1992

OTHER PUBLICATIONS

Written Opinion issued in International Application No. PCT/NO2015/050199 dated Jan. 20, 2016.
European Search Report issued in European Patent Application No. 15854799 dated Apr. 9, 2018.

* cited by examiner

SEATING FURNITURE

CROSS-REFERENCE TO RELATED APPLICATION

This application is a 35 U.S.C. 371 National Phase of PCT Application No. PCT/NO2015/050199 filed Oct. 27, 2015 which claims priority to NO Application No. NO 20141278 filed Oct. 27, 2014. The disclosure of these prior applications are hereby incorporated by reference herein.

FIELD OF THE INVENTION

The invention relates to seating furniture, such as chairs or sofas, having a seat and a movable back. More precisely, the invention relates to a seating furniture as indicated in the preamble of claim 1.

BACKGROUND OF THE INVENTION

There are various variants of adjusting the seating position of seating furniture. That is, adjusting the way the seat and the back move relative to one another and relative to the base, also called sliding path. Traditional reclining chairs or recliner sofas with movable backs suffer from several disadvantages. When the back is reclined, the seat slides upwards and forwards, leading to reduced leg space when the chair or sofa is positioned near a coffee table or another chair in front of it. This leads to a situation, for instance, where a coffee table has to be placed further away from the seating location than what is desirable when the back is the upright position. In another known variant, the back alone moves while the seat remains stationary, in which case the seat has the same angle relative to the horizontal plane and the user will have the impression of sliding off the chair when the back is reclined. The same is experienced with traditional recliners where the seat moves forward and up at the rear end.

It is an object of the invention to provide a seating furniture with adjustable back, which does not suffer from the same disadvantages as the known seating furnitures.

SUMMARY OF THE INVENTION

The invention is described in and characterized by the independent claim, whilst the dependent claims present other characteristics of the invention.

Thus, there is provided a seating furniture having a seat device and a backrest device which are connected via at least one first rotatable coupling at respective coupling portions of the backrest device and at the rear portion of the seat device, and a base arranged to support the seat device and the backrest device; characterized

- in that the backrest device comprises at least a portion extending in a direction towards the base and past the first rotatable coupling, and in that said at least one portion is rotatably coupled to and supported on the base via at least one respective link arm, and
- in that the seat device is rotatably coupled to and supported on the base via a second rotatable coupling attached closer to the front end of the seat device than the first rotatable coupling; and
- by a lockable control device arranged for controlling the movement between the backrest device and the seat device.

In an embodiment, the second rotatable coupling is arranged between the center and the front end of the seat device. In an embodiment, the second rotatable coupling is arranged closer to the center than to the front end.

In an embodiment, the link arm has a first end that is coupled to said portion via a first joint and a second end that is coupled to the base via a second joint.

A crucial aspect of the invention is that the back frame is supported centrically through the fixed arm leading to the link arm in the support structure placed under the seat frame.

The invention makes it possible to change the angle of the back of the chair and the seat at the same time, without the seat moving forward. The seating furniture according to the invention has the characteristic that the angle between the seat and the horizontal plane is increased by the lowering of the rear portion of the seat when the back is being reclined. A sliding path is obtained which gives the body good balance in all positions. The mutual movement of the back and the seat are controlled by a lever which opens or closes a gas spring that balances weight and forces in a completely new way. The mechanism of the sitting furniture is simple in the sense that it is comprised of very few parts, making it a light-weight, safe and sturdy construction.

The seat and the back of the seating furniture have no mechanism or external bearing points, since everything is concealed by the padding and/or the outer cover. This provides a huge freedom of design, since both the seat and the back are supported under the chair.

The invention is applicable to all types of seating furniture that have a mutually moveable seat and back. Examples include recliner chairs, reclining sofas, office chairs and chairs in control rooms and offices, dentist's chairs, seating furniture in assembly rooms and public means of transport.

BRIEF DESCRIPTION OF THE DRAWINGS

The aforementioned and other characteristics of the invention will be further explained in the following description of an embodiment representing a recliner, presented as a non-limiting example, with reference to the attached drawings, wherein.

DETAILED DESCRIPTION OF A PREFERRED EMBODIMENT

Figure 1:
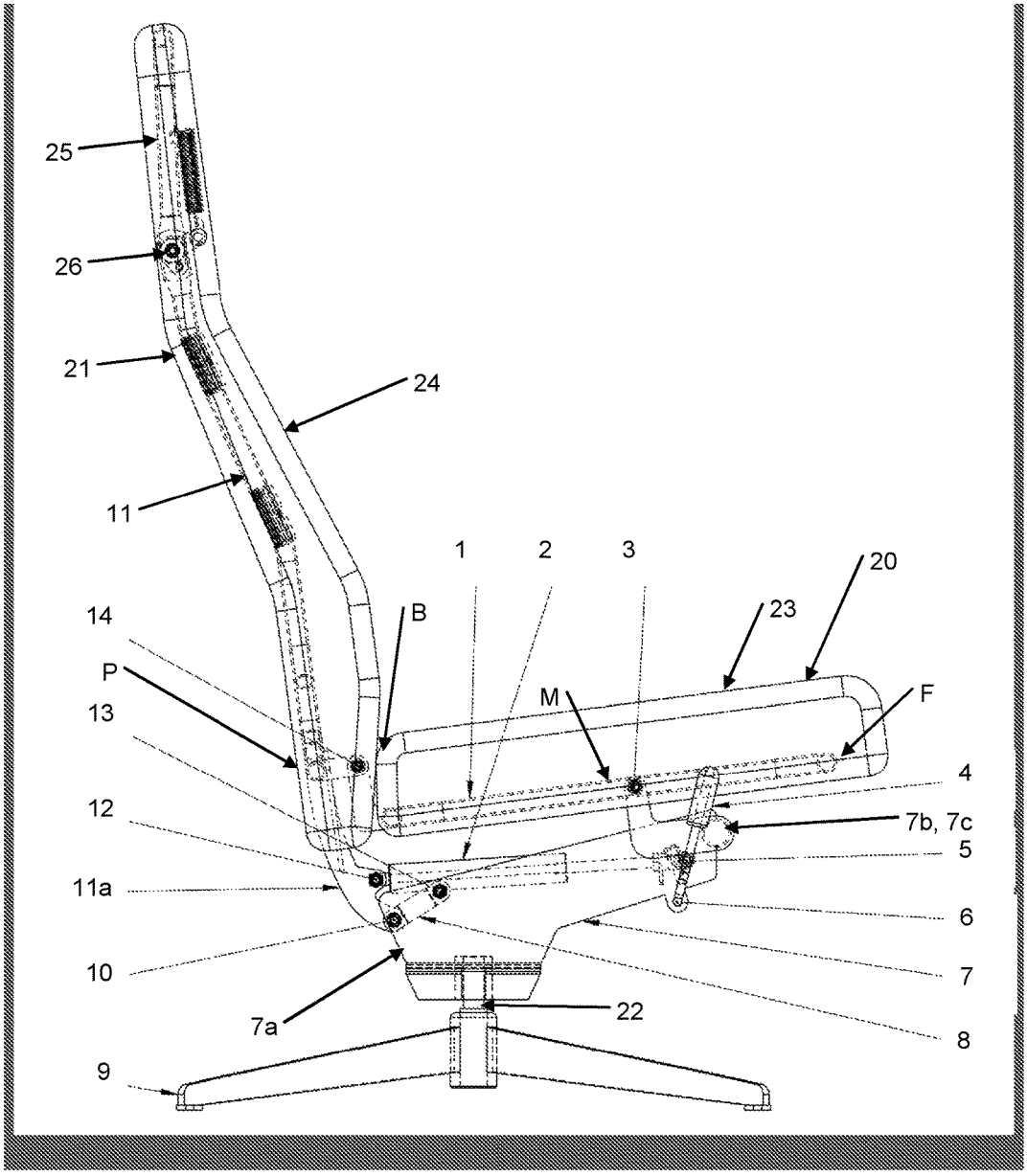
FIG. 1 shows an embodiment of a seating furniture according to the invention as seen from one side, with the back in an upright position, where parts and components which during normal use are hidden by the cover, padding, etc. of the seating furniture, are shown in broken lines.

FIG. 1 shows a seating furniture in the form of a recliner (hereinafter simply referred to as "chair") comprising a seat 20, a back 21 and a foot 9. The seat and the back are coupled to a support structure 7—in a way that will be described in the following—and the support structure is rotatably (in the horizontal plane) supported on the foot via a stem 22 in essentially known manner. In the embodiment illustrated, the foot 9 is a so-called cross foot; however, this is an example only. The invention shall not be limited to this type of foot.

The seat 20 has a seating portion 23 (e.g. a textile-covered pad or the like) which is built up all the way around and attached to a seat frame 1 (shown in broken lines in FIG. 1) in an essentially known manner. The back 21 has a backrest portion 24 (e.g. a textile-covered pad or the like) which is built up all the way around and attached to a back frame 11 (shown in broken lines in FIG. 1) in an essentially known manner.

Figure 2:
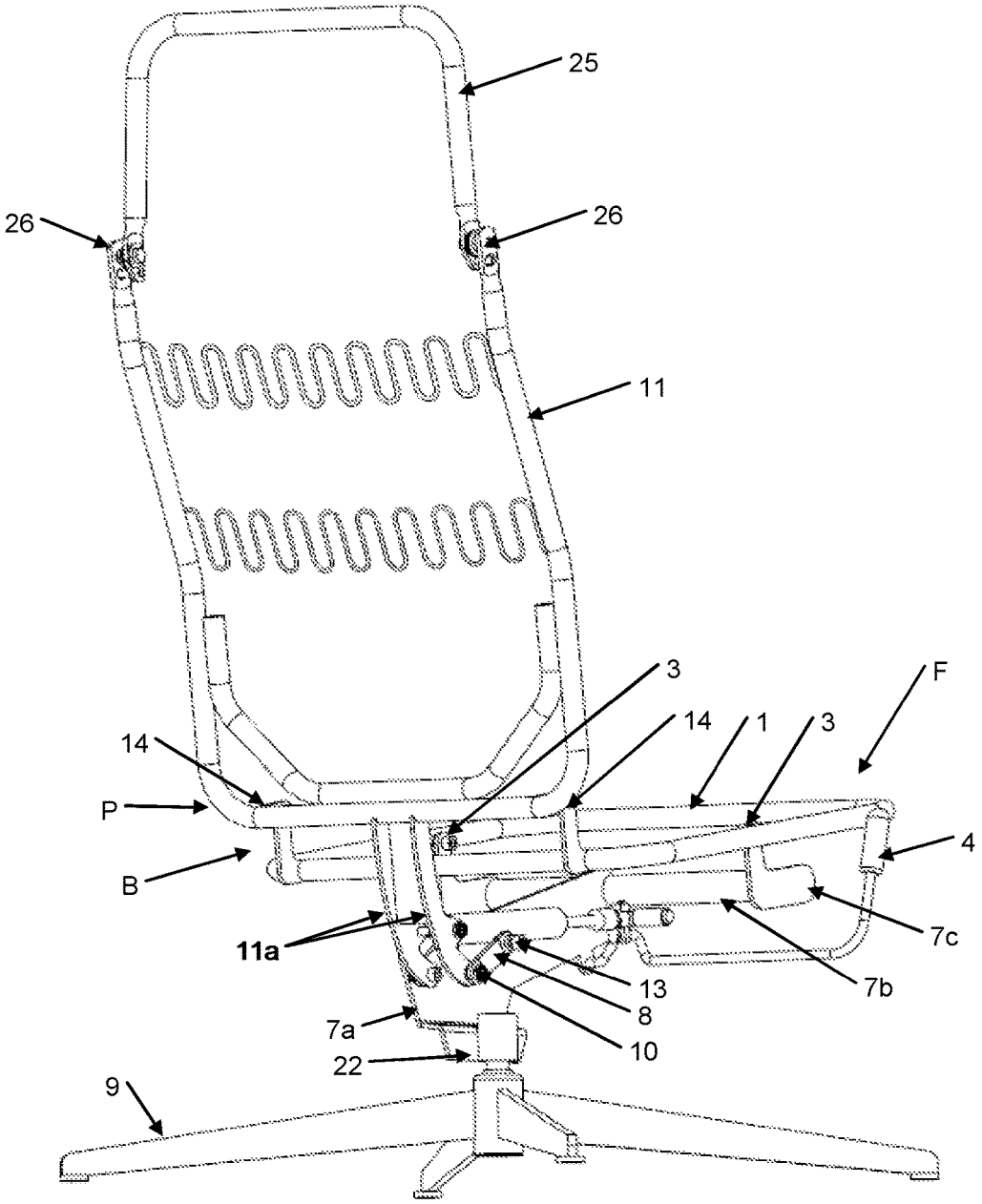
FIG. 2 is a perspective drawing of the embodiment shown in FIG. 1, where padding and cover are removed to illustrate the structural and mechanical components of the seating furniture.

Now, reference is also made to FIG. 2, which shows structural and mechanical components, without any cover, upholstery or other padding or covering. As can be seen in FIG. 2, both the seat frame 1 and the back frame 11 have an essentially known configuration which allows for the installation of seat and back pads. Since the invention relates to the framework of the chair and its structural configuration and functioning, such upholstery, padding or covering will not be described in any more detail.

The back frame 11 in the embodiment shown has an (optional) upper portion 25, particularly suited as a headrest, which is rotatably coupled to the back frame 11 via a headrest joint 26 on each side, as shown in FIG. 2.

The support structure 7 in the embodiment illustrated comprises a central element 7*a* (to which the stem 22 is attached), and a transverse rod 7*b* is attached to the central element. At each end of the transverse rod, an upwards extending horn 7*c* is attached (in the Figures, only one horn is shown, the other one is concealed). It is to be understood that the support structure may have other configurations than the one shown in the Figures.

The seat frame 1 is rotably coupled to the support structure 7 via a first seat frame bearing 3 on each side of the seat frame (see FIG. 2). In the embodiment shown, the first seat frame bearings 3, which may be bolt connections or the like, are located at the upper end of each of the horns 7*c*. It clearly arises from FIG. 1 that the first seat frame bearings 3 are located somewhat in front of the center M of the seat frame, i.e. closer to the front end F of the seat frame than to its rear end B. This results in a good sliding path.

The seat frame 1 is rotatably coupled at its rear portion B to the back frame 11 (at a coupling portion P) via two seat/back couplings 14, for example bolt connections or the like, in an essentially known manner.

The back frame 11 comprises at its lower end a pair of fixed arms 11*a* extending underneath the coupling portion P. Each of the arms is rotatably coupled to the central element 7*a* of the support structure 7 via respective link arms 8 (only one is shown in the Figures due to the perspective used in the Figures), via first and second bolt connections 10, 13. The Figures show how the first bolt connection 10 is a rotatable coupling between the link arm 8 and the back frame 11, and the other bolt connection 13 is a rotatable coupling between the link arm 8 and the support structure 7. The link arms 8 are elongated plate elements in the embodiment shown. The articulated connection of the back frame to the support structure 7 (via link arms 8) is thus closer to support structure than the above-mentioned seat/back couplings 14.

Figure 3:
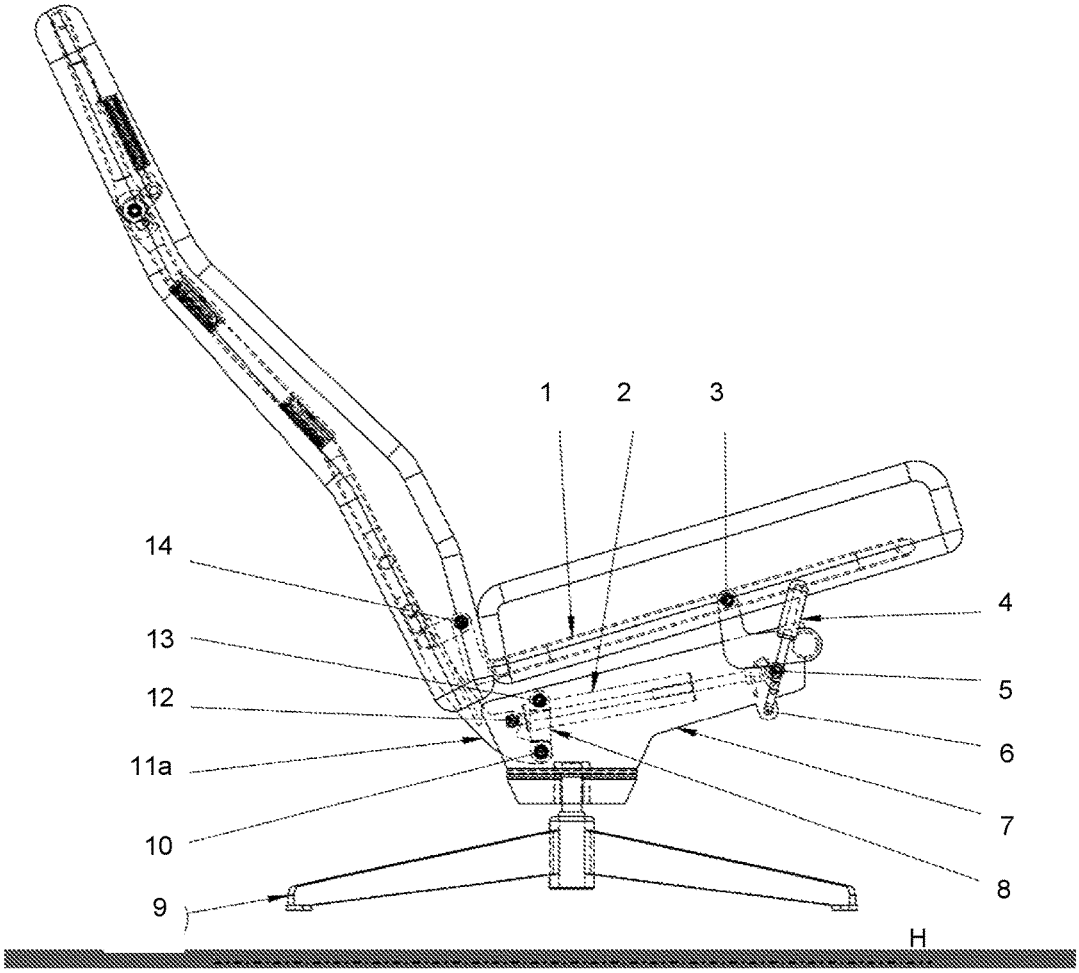
FIG. 3 corresponds to FIG. 1, but shows the seating furniture with the back in a first reclined position.
Figure 4:
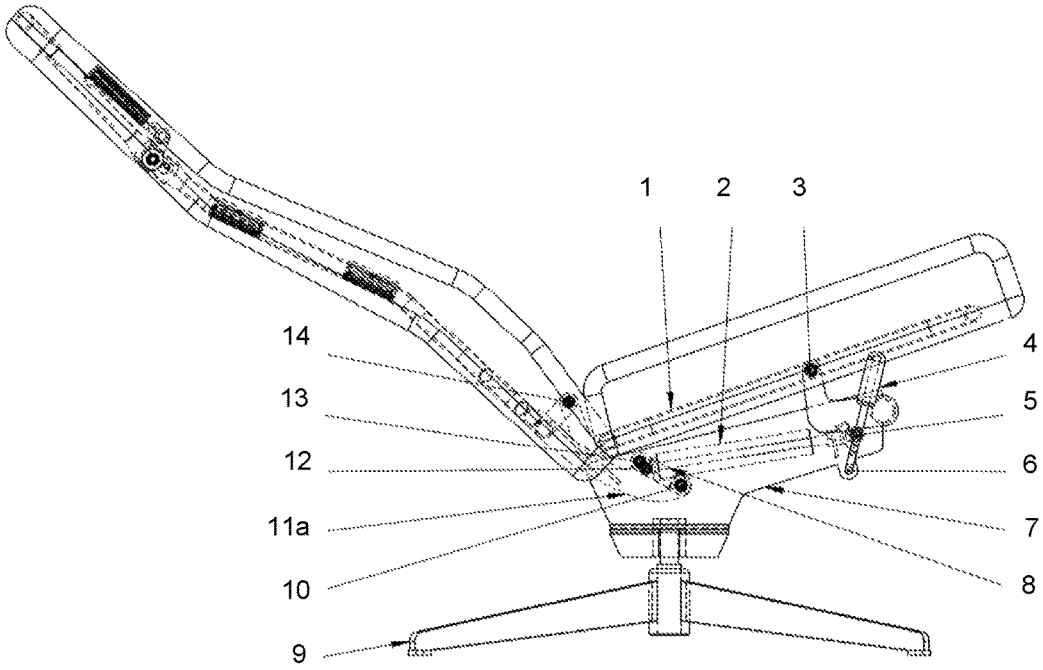
FIG. 4 corresponds to FIG. 1, but shows the seating furniture with the back in a second reclined position.

FIGS. 3 and 4 show the chair in two different reclining positions. In the Figures, it can be seen how the link arm 8, its location and its length determine the angular relationship between the back frame 11 and the seat frame 1 and the horizontal plane H.

The relative movements of the seat frame and the back frame in the embodiment illustrated can be controlled continuously by a gas spring 2 (of essentially known type), which can be operated (i.e. locked or released) by the user of the chair by mans of a control lever 4. The gas spring 2 has one end coupled to the support structure 7 via a rotatable third bolt connection 5, and has the other end coupled to the back frame 11 (more precisely, the arms 11*a*) via a rotatable fourth bolt connection 12. The point of action of the gas spring in the embodiment shown is thus located between the seat/back coupling 14 and the first bolt connections 10 of the link arms 8. It is to be understood that the gas spring 2 can be replaced by other locking and control arrangements, for instance an electric motor.

When a user sits down in the chair in the position as shown in FIG. 1 (upright back), opens the gas spring by means of the lever 4 and simultaneously exerts pressure to the back of the chair, the back will slowly recline (see FIGS. 3 and 4). Due to the location and configuration of the link arms 8, the seat frame 1 (and consequently the seat 20) will we pulled down at the rear end B (i.e. via the seat/back coupling 14) and guide the back frame 11 (and consequently the back 21) downwards at the same time as the back is being reclined. It can be seen in FIGS. 1, 3, 4 that the link arm 8 rotates around the second bolt connection 13 (i.e. in the rotatable attachment of the bearing structure) when the back frame 11 and the seat frame 1 change their angles with the horizontal plane H.

Due to the location of the link arm 8 (and a pre-set gas spring 2), the « counter-pressure » from the back will not decrease when the back reaches a position far back. Thus, the gas spring provides good support to return the back and the seat to an upright position. An expert of the field will appreciate that the above-mentioned movements can be controlled and provided with a desired "gearing" by carefully calculating the dimensions (e.g. the length) and the location of the link arm. The construction is thus well-balanced, and low forces are required to control the chair in all positions.

The invention claimed is:

1. Seating furniture that is moveable between an upright position and a reclined position, comprising:

a seat device and a backrest device which are connected via at least one first rotatable coupling at a first respective coupling portion (P) of the backrest device and at a rear portion (B) of the seat device;

a base arranged to support the seat device and the backrest device;

wherein the backrest device comprises a first portion extending downwardly in a direction towards the base and past the first rotatable coupling, wherein the first portion is rotatably coupled to the first end of a link arm via a first link arm coupling, wherein the second end of the link arm is rotatably coupled to the base via a second link arm coupling;

wherein the seat device is rotatably coupled to and supported on the base via a second rotatable coupling attached closer to a front end (F) of the seat device than the first rotatable coupling; and a lockable control device rotatably coupled to the first portion via a first control device coupling and rotatably coupled to the base via a second control device coupling, wherein the lockable control device controls movement between the backrest device and the seat device, wherein a distance between the first control device coupling and the second control device coupling decreases as the backrest device is reclined.

2. Seating furniture according to claim 1, wherein the second rotatable coupling is arranged between a center (M) and the front end (F) of the seat device.

3. Seating furniture according to claim 2, wherein second rotatable coupling is arranged closer to the center (M) than the front end (F).

4. Seating furniture according to claim 1, wherein the link arm is coupled to the first portion via a first rotatable joint at the first end and is coupled to the base via a second rotatable joint at the second end.

5. Seating furniture according to claim 1 wherein the control device is a gas spring.

6. Seating furniture according to claim 1, wherein the first link arm coupling is located further from the seat device than the first control device coupling.

7. Seating furniture according to claim 1, wherein the first link arm coupling is located further from the seat device than the second link arm coupling.

8. Seating furniture according to claim 1, wherein the second link arm coupling is located further from the front end than the second control device coupling.

9. Seating furniture according to claim 1, wherein the first control device coupling is located closer to the seat device than the first link arm coupling, wherein the first link arm coupling is located further from the seat device than the second link arm coupling, and wherein the second link arm coupling is located further from the front end than the second control device coupling.

* * * * *